US008715021B2

(12) United States Patent
Horkko et al.

(10) Patent No.: US 8,715,021 B2
(45) Date of Patent: May 6, 2014

(54) SERVICE SPACE FOR A RETRACTABLE PROPULSION DEVICE

(75) Inventors: Tuija Horkko, Rauma (FI); Timo Rintala, Rauma (FI); Tommi Korte, Rauma (FI); Juhani Suutari, Rauma (FI)

(73) Assignee: Beacon Finland Ltd Oy, Rauma (FI)

( * ) Notice: Subject to any disclaimer, the term of this patent is extended or adjusted under 35 U.S.C. 154(b) by 209 days.

(21) Appl. No.: 13/254,857

(22) PCT Filed: Mar. 5, 2009

(86) PCT No.: PCT/FI2009/050181

§ 371 (c)(1),
(2), (4) Date: Sep. 16, 2011

(87) PCT Pub. No.: WO2010/100313

PCT Pub. Date: Sep. 10, 2010

(65) Prior Publication Data

US 2011/0315061 A1 Dec. 29, 2011

(51) Int. Cl.
*B63H 5/125* (2006.01)

(52) U.S. Cl.
USPC ..... 440/54

(58) Field of Classification Search
USPC ..... 440/53, 54
See application file for complete search history.

(56) References Cited

U.S. PATENT DOCUMENTS

| | | | | |
|---|---|---|---|---|
| 3,483,843 A | | 12/1969 | Hawthorne | 115/41 |
| 4,075,971 A | * | 2/1978 | Reginensi et al. | 440/54 |
| 4,226,206 A | | 10/1980 | Wilson | 440/112 |
| 4,668,195 A | | 5/1987 | Smith | 440/6 |
| 5,397,255 A | | 3/1995 | Heer | 440/54 |
| 5,435,762 A | * | 7/1995 | Reuter | 440/54 |
| 6,375,524 B1 | | 4/2002 | Commandeur et al. | 440/54 |
| 6,439,936 B1 | | 8/2002 | Dreith et al. | 440/54 |
| 2007/0253821 A1 | | 11/2007 | Gabriel | 416/189 |

FOREIGN PATENT DOCUMENTS

| | | |
|---|---|---|
| EP | 0613817 | 9/1994 |
| NL | 1 020 217 | 5/2002 |

* cited by examiner

*Primary Examiner* — Edwin Swinehart
(74) *Attorney, Agent, or Firm* — James C. Lydon

(57) ABSTRACT

The invention relates to a service space of a retractable propulsion device or corresponding system in a vessel or corresponding floating structure, which service space (11) comprises a closed or closable space limited by walls, a top structure and a bottom in which an access has been arranged for the crew (C) from the other parts of the vessel or corresponding floating structure. The service space (11) is constructed into connection with the bottom (2) of the vessel or corresponding floating structure so that the propulsion device (4) or corresponding system is retractable from an operating position into a service/storage position within the service space (11) and correspondingly lowerable from the service space (11) down into the operating position. According to the invention, the service space (11) is located at least mainly below a waterline (WL) of the vessel or corresponding floating structure and is provided with watertight closing devices (14) arranged on the level of the bottom (2) of the vessel or corresponding floating structure. When opened, the closing devices (14) constitute a direct access from the service space (11) to water via the bottom (2) of the vessel or corresponding floating structure for lowering the propulsion device (4) or corresponding system from the service space (11) to water into the operating position i.e. operating mode and correspondingly for lifting it from water within the service space (11) into the service/storage position i.e. service/storage mode. When closed, the closing devices (14) constitute together with the top and wall structures of the service space (11) a watertight space from which water is removable after closing the closing devices (14).

10 Claims, 2 Drawing Sheets

SERVICE SPACE FOR A RETRACTABLE PROPULSION DEVICE

FIELD OF INVENTION

The invention relates to engineering rooms of retractable propulsion systems or corresponding systems and their structures in vessels and other floating structures. Floating structures refer to e.g. drilling and service rigs or corresponding. In more detail, the invention relates to a service space of a retractable propulsion device or corresponding system in a vessel or corresponding floating structure, which service space comprises a closed or closable space limited by walls, a top structure and a bottom in which an access has been arranged for the crew from the other parts of the vessel or corresponding floating structure, and which service space is composed into connection with the bottom of the vessel or corresponding floating structure, whereby the propulsion device or corresponding system is liftable from an operating position into a service/storage position and equivalently lowerable from the service space down into the operating position.

BACKGROUND OF INVENTION

As the main propulsion or in addition to the main propulsion devices, vessels and corresponding floating structures having to stay in place for working utilise propulsion devices rotatable and controllable in a known manner for this staying in place. Such vessels are e.g. drilling ships used for oil and gas prospecting, various research vessels and vessels servicing underwater structures. Also oil and gas drilling rigs, service ferries and corresponding are known having been provided with such rotatable propulsion devices. Such vessels and corresponding floating structures are intended to stay in place for working for very long periods of time, whereby, inter alia, the servicing and repair possibilities of the propulsion devices constitute a considerable problem, because it is not often possible to take these vessels to the dockyard for servicing and repairs but they have to be performed on the spot.

Particularly for servicing and repairs, e.g. U.S. Pat. Nos. 6,375,524 and 6,439,936 earlier described arrangements in which, in the structures of a vessel, a shaft or a pit extending through the whole vessel in the vertical direction, open from its both ends, i.e. from top and bottom, is constructed for a propulsion device. For the propulsion device, a watertight propulsion machine room ("Canister") is constructed which usually includes a drive motor and a gearbox, a control unit, cooling, hydraulics etc. of the propulsion device. The propulsion machine room is installed in the above-mentioned shaft in which it is movable in the vertical direction. When the propulsion machine room is in the shaft in the lower position, i.e. when the propulsion device is in its operating position located below the vessel bottom, sealing surfaces between the shaft and the propulsion machine room are closed, whereby water cannot rise in the shaft. When the propulsion machine room and the propulsion device are lifted into the service position, the sealing surfaces open and water is able to rise in the shaft. Due to this, the propulsion machine room with its propulsion device has to be lifted totally above the vessel waterline in order to be able to perform required servicing and repair measures. Then, the shaft is filled with water up to the waterline, whereby the use of the service space is limited as water heaves in the shaft. Water is not removed from the shaft until the propulsion machine room with its propulsion device is lowered down so that the sealing surfaces close.

A disadvantage of this kind of prior-art arrangement is, inter alia, that when the structure is lifted in the upper position, the unit is awkward to support. Wind and rough seas create limitations for the retraction of the Canister. In rough wind and seas, it is not thus possible to service the propulsion devices, which might impede or even prevent the operation of the vessel. A vessel, which is provided with arrangements of the Canister type, cannot be run when the propulsion machine room is in the upper position. When moving the propulsion device (Canister), the lifted mass is extremely large, because in the system the whole machine room is lifted with its propulsion device and required components. The lifting distance is also great, because the whole structure alongside the propulsion device has to be lifted above the waterline. Such a propulsion machine room is extremely difficult to realise in vessels low of their structure. The propulsion machine room being lifted within the hull, the open shaft constitutes a discontinuity point with the bottom of the vessel or floating structure causing additional resistance when in motion.

SUMMARY OF INVENTION

The object of the present invention is to provide a novel arrangement for a service space of a retractable propulsion device or corresponding system in a vessel or corresponding floating structure. For achieving this object, the invention is mainly characterised by that the service space is located at least mainly below the waterline of the vessel or corresponding floating structure and is provided with at least one watertight closing device arranged substantially on the level of the bottom of the vessel or corresponding floating structure which closing device/devices when unlocked constitutes/constitute a direct access from the service space to water via the bottom of the vessel or corresponding floating structure for lowering the propulsion device or corresponding system from the service space to water into an operating position i.e. operating mode and correspondingly for lifting it from water within the service space into a service/storage position i.e. service/storage mode, and which can, when closed, constitute together with the top and wall structures of the service space a watertight space from which water is removable after having closed the closing devices.

The propulsion device or corresponding system being in the operating mode, the closing devices of the service space are unlocked and the propulsion device or corresponding system is mechanically locked in the hull structures of the vessel or corresponding floating structure so that a support structure of the propulsion device or corresponding system constitutes a watertight contact surface and joint with the hull of the vessel or corresponding floating structure. Forces resulting from the motions of the vessel or corresponding floating structure and the hydrodynamics of a propeller of the propulsion device are arranged to convey via the locking devices of the propulsion device to the hull structures of the vessel or corresponding floating structure. The closing devices are then positioned within the service space so that the propulsion device or corresponding system is retractable unobstructed within the service space into the service/storage mode.

The service space is provided with remote-controlled locking devices with which, the propulsion device or corresponding system being in the operating mode or the service/storage mode, the support structure of the propulsion device or corresponding system is fastened and mechanically locked in the hull of the vessel or corresponding floating structure, and further the service space is provided with lifting devices for lifting the propulsion device or corresponding system from water to the service space and for lowering it from there to water. Furthermore, in the service space is arranged at least one ventilation pipe provided with closing valves.

A driving mechanism of the propulsion device or corresponding system is located in a compartment separated from the service space with a watertight bulkhead or deck, whereby for retracting the propulsion device or corresponding system from the operating mode into the service/storage mode, a coupling between the propulsion device or corresponding system and its driving mechanism is decoupled where required.

The invention provides considerable advantages in relation to known prior art. In the new invention, the propulsion device or corresponding is lifted within the vessel, the watertight closing devices at the vessel bottom are closed and water having come within in connection with the retraction of the device is pumped out of the space. Thus, an engineering room is provided within the vessel in which the propulsion device or corresponding can be stored, serviced etc. In this invention, it is not required to lift the propulsion device or corresponding above the waterline for access. The lifting distance is thus relatively small and, compared to prior-art watertight propulsion machine room arrangements, the movable mass is also considerably smaller. Space saving is considerable. It is not of necessity to construct in the vessel a shaft going through the vessel in the vertical direction, even though it might be advantageous to arrange the shaft for hauling large components. It is also possible to run the vessel when the propulsion device or corresponding is locked in the service position. The arrangement according to the invention enables performing servicing measures in the most difficult wind and wave conditions. In the arrangement according to the invention, the underwater device being retracted, the closing devices constitute a uniform surface with the floating structure. This causes less flow resistance (energy saving) when moving the floating structure compared to prior-art arrangements. In the arrangement according to the invention, the harmful heaving of water in the shaft is not possible.

Other advantages and characteristics of the invention will become evident in the following detailed description of the invention in which the invention is depicted with reference to the figures of the enclosed drawing which show an advantageous embodiment of the invention to the details of which the invention is not solely limited.

BRIEF DESCRIPTION OF FIGURES

The figures of the drawing show an embodiment of the invention in connection with a propulsion device so that FIG. 1 generally shows a propulsion device installed in a vessel and an engineering room according to the invention seen from the side of the vessel the propulsion device being in an operating position, FIG. 2 correspondingly shows the arrangement according to FIG. 1 seen from the right-hand side of FIG. 1, FIG. 3 corresponds FIG. 1 the propulsion device being in a service position.

DETAILED DESCRIPTION OF AN ADVANTAGEOUS EMBODIMENT ACCORDING TO FIGURES

Figure 2:
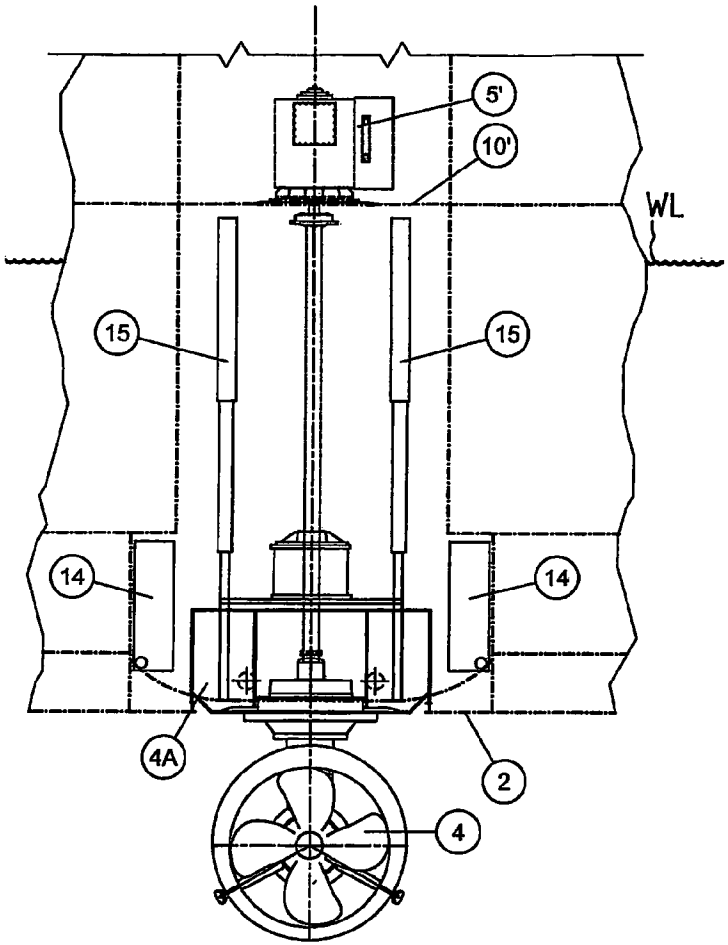

The figures of the drawing thus show an arrangement in which in a vessel is installed a propulsion device retractable within the vessel and for this propulsion device in the vessel is arranged an engineering room, a service space or corresponding. In the figures, the level of a vessel deck is designated with reference number 10' and correspondingly the level of a vessel bottom is designated with reference number 2. A space above the deck 10' is totally dry space and correspondingly in a space below the deck 10' is composed an engineering room 11 which is used as a service space for a propulsion device 4 in the example of the figures.

Figure 1:
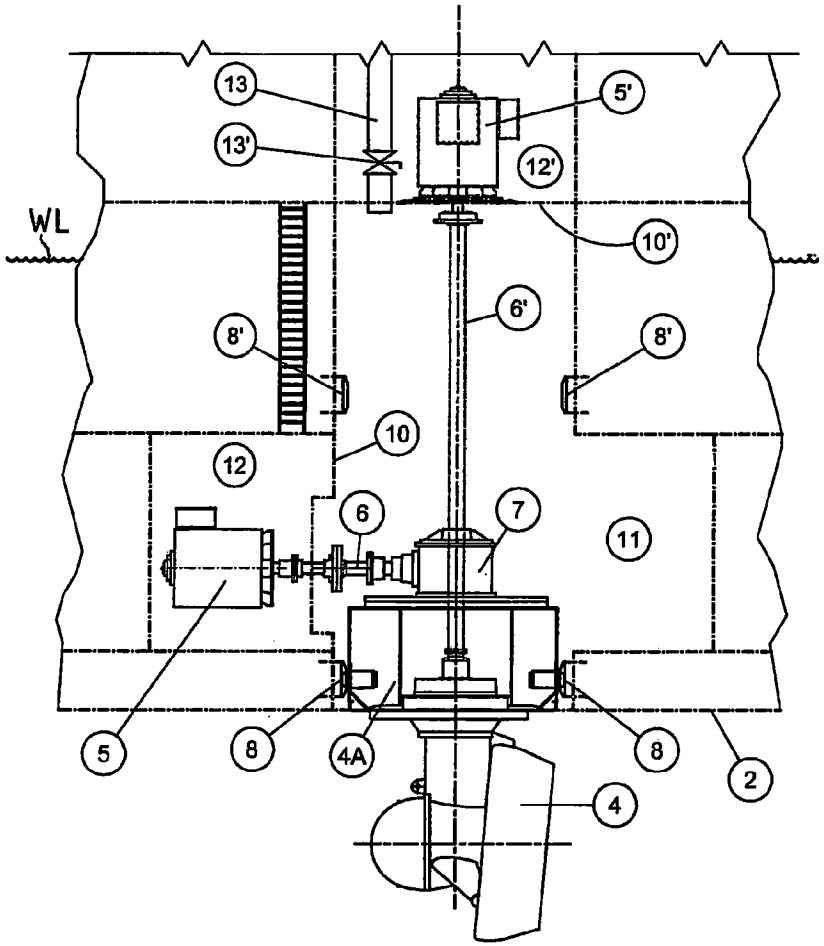

In FIGS. 1 and 2, the propulsion device 4 is in an operating position i.e. it is lowered down in an operating mode. In the operating mode, the propulsion device 4 is mechanically locked and fastened with remote-controlled locking devices 8 in the hull structures of the vessel. A support structure **4*a* of the propulsion device 4 then constitutes with the vessel hull a watertight contact surface and joint. Forces resulting from the motions of the vessel or other floating structure and the hydrodynamics of a propeller of the propulsion device 4 are conveyed via the locking devices 8 of the propulsion device 4 to the hull structures of the vessel. A driving mechanism 5 of the propulsion device 4 can be located either on the side of the propulsion device 4 or above the propulsion device 4 as shown with dashed lines and designation 5'. The driving mechanism 5 being on the side of the propulsion device 4, the propulsion device 4 is provided with an angled gear 7 and a drive shaft 6. The driving mechanism 5' being above the propulsion device 4, the transmission is implemented via a line shaft 6'. In both cases, the driving mechanism 5, 5' is located in its own compartment 12, 12' which is separated of the engineering room 11 i.e. the service space with a watertight bulkhead 10 or deck 10'. In the engineering room 11 are installed closing devices 14 with which the bottom of the engineering room 11 is watertightly closeable from below when the propulsion device 4 is retracted. In the operating mode of FIGS. 1 and 2, the closing device/devices 14 of the bottom are positioned within the engineering room 11 so that they form no obstruction in the retraction stage of the propulsion device 4**.

Figure 4:
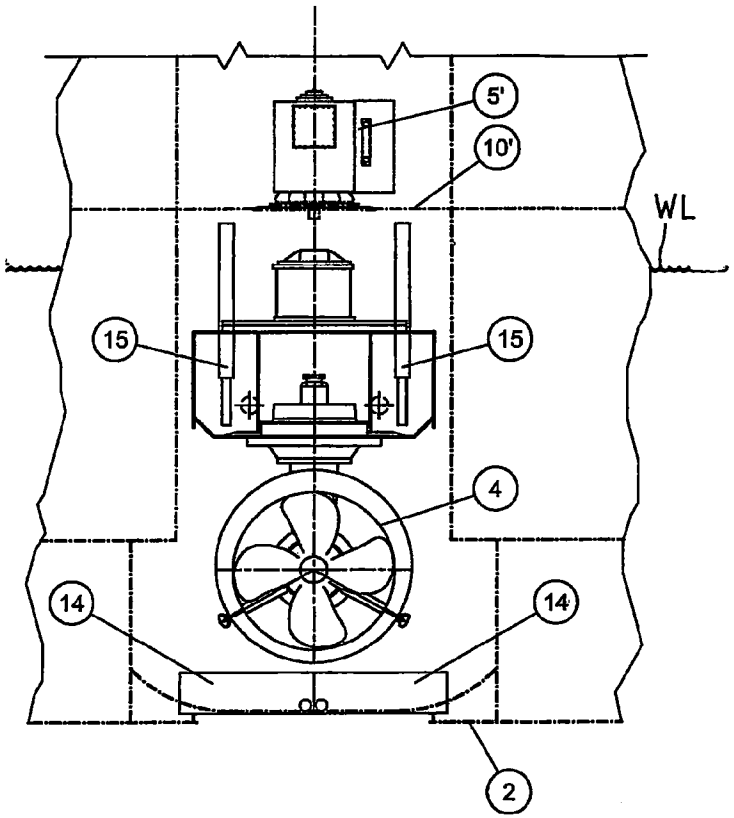
FIG. 4 shows the arrangement according to FIG. 3 seen from the right-hand side of FIG. 3.
Figure 3:
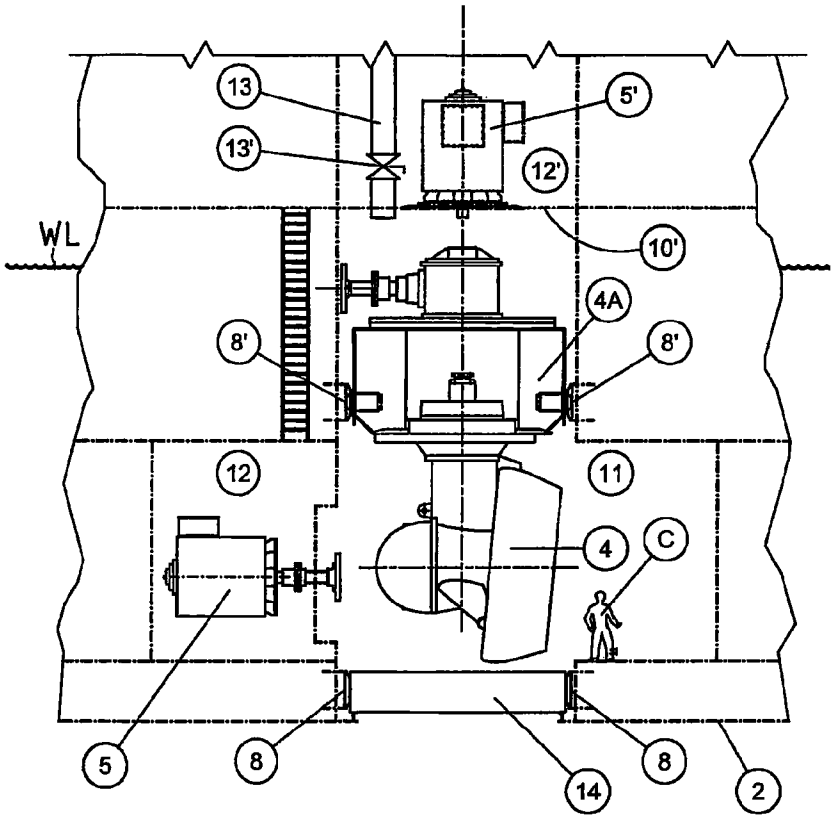

In FIGS. 3 and 4, the propulsion device 4 is in a service/storage mode retracted within the vessel. Into this service/storage mode, the propulsion device 4 is lifted, inter alia, when the vessel enters shallow water, for the time of transfer run or when the propulsion device 4 requires servicing. Before retracting the propulsion device 4, propulsion shafts between the propulsion device and the driving mechanism 5, 5' driving it are detached or removed where required. For example, the driving mechanism 5 being located on the side of the propulsion device 4, the drive shaft 6 between the driving mechanism 5 and the propulsion device 4 is removed or detached. Cablings, hosings etc. of the propulsion device 4 are detached where required. On top of the propulsion device 4 and in other required places are installed watertight protective caps (not shown in the figures) according to the instructions of the supplier if such protective caps are required. If necessary, the underwater removal of the propulsion device is performed according to the instructions of the supplier.

The mechanical lockings between the support structure **4*a* of the propulsion device 4 and the vessel hull are unlocked. The propulsion device 4 with its support structure 4*a* is still in this stage fastened with the remote-controlled locking devices 8 in the vessel hull further constituting a watertight joint. After this, the crew C exits the engineering room 11 and closes the watertight structures of the compartment including closing valves 13' of ventilation pipes 13 of the engineering room 11 on top of the watertight deck 10'. The remote-controlled locking devices 8 are unlocked and the lifting of the propulsion device unit comprising the propulsion device 4 and the support structure 4*a* of the propulsion device can be started with lifting devices 15. In the example of FIGS. 2 and 4, the lifting devices 15 are hydraulic, particularly hydraulic cylinders 15. As the lifting devices, it is also possible to use pneumatic or mechanical lifting devices. It should yet be understood that also other lifting devices can be used and the above-described uses are only advantageous examples. The propulsion device 4, particularly the support structure 4***a* of the propulsion device having lifted up from the sealing surfaces, water is able to access the engineering room 11. Due to the closing valves 13' of the ventilation pipes 13 of the engineering room 11, the water surface does not rise up to the waterline of the vessel, because an airbed has been formed in the engineering room 11. Thus, the volume of water pumped out is smaller. For minimising the water volume, the space can also be pre-pressurised. It is also possible to leave the ventilation pipes 13 or corresponding air channels unclosed, whereby the space is filled with water up to the waterline WL. The watertight top structure i.e. the deck 10' of the engineering room 11 is slightly above the construction water line WL of the vessel. The propulsion device 4 reaching its upper position, the watertight closing device/devices 14 of the vessel bottom 2 are closed and the propulsion device 4 is locked in its upper position by means of the remote-controlled locking devices 8'. Due to the closing device/devices 14, the engineering room 11 becomes a totally watertight space. After the opening of the closing valves 13' of the ventilation pipes 13, the engineering room 11 is emptied of water. The crew C then enters the engineering room 11 and locks the closing device/devices 14 mechanically. Bringing the propulsion device 4 in the drive position i.e. operating mode occurs in the opposite order.

The invention was described above by way of examples with reference to the figures of the enclosed drawing. The invention is not, however, solely limited to the embodiments shown in the figures, but the various embodiments of the invention can vary within the scope of the inventive idea presented in the enclosed claims.

The invention claimed is:

1. A service space (11) for a retractable propulsion device in a floating vessel hull, comprising a closeable space defined by walls, a top structure and a bottom comprising a portion of a exterior periphery of the hull, in which space an access is arranged for a crew (C) from other parts of the vessel, a retractable propulsion device (4) which is retractable from an operating position in which a propeller of said propulsion device is submerged in water into a service position within said closable space, a support structure (4A) attached to said propulsion device (4), wherein said service space (11) is located at least mainly below a waterline (WL) of said vessel, wherein said bottom of said closeable space further comprises a watertight closing device (14) which is open while propulsion device (4) is in its operating position, thereby providing a direct access from the service space (11) to water, and which is closable when said propulsion device (4) is in said service position, thereby defining, in combination with the top and wall structures of the service space (11), a watertight space from which water is removable, and wherein said support structure (4A) forms a watertight seal with said exterior periphery of the hull of said vessel when said propulsion device (4) is in its operating position.

2. The service space of claim 1, further comprising devices for locking said watertight closing device (14) into a closed position.

3. The service space of claim 1, further comprising devices for locking (8) said propulsion device (4) into said operating position.

4. The service space of claim 3, wherein said devices for locking (8) are capable of transmitting forces to said hull, which forces result from the motions of the vessel and the hydrodynamics of said propeller of propulsion device (4).

5. The service space of claim 1, wherein, when the propulsion device (4) is in its operating position, said closing device (14) is positioned within service space (11) such that the propulsion device (4) is retractable from said operating position into said service position without obstruction from said closing device (14).

6. The service space of claim 1, further comprising remote-controlled locking devices ( 8, 8') for locking support structure (4*a*) in place when said propulsion device (4) is in said service position.

7. The service space of claim 1, further comprising at least one lifting device (15) for retracting propulsion device (4) from said operating position to said service position within the service space (11) and for lowering said propulsion device (4) from said service position to said operating position.

8. The service space of claim 1, further comprising at least one ventilation pipe (13) having at least one closable valve (13').

9. The service space of claim 1, in combination with at least one driving mechanism for said propulsion device (4), said driving mechanism located in a compartment (12) separated from the service space (11) by a watertight bulkhead or deck.

10. The service space of claim 9, further comprising a detachable coupling which joins propulsion device (4) and said driving mechanism, such that said driving mechanism can be detached from said propulsion device (4) when said propulsion device (4) is retracted from its operating position into its service position.

* * * * *